US006186086B1

(12) United States Patent
Zender et al.

(10) Patent No.: US 6,186,086 B1
(45) Date of Patent: Feb. 13, 2001

(54) PLANING BOAT HULL AND METHODS OF MAKING SAME

(76) Inventors: James F. Zender, 1055 S. Weller; Charles C. Mauldin, 5015 S. Glenhaven, both of Springfield, MO (US) 65804

( * ) Notice: Under 35 U.S.C. 154(b), the term of this patent shall be extended for 0 days.

(21) Appl. No.: 09/487,096

(22) Filed: Jan. 19, 2000

(51) Int. Cl.[7] ..... B63B 1/00
(52) U.S. Cl. ..... 114/271
(58) Field of Search ..... 114/56.1, 271, 114/274, 291, 355, 357

(56) References Cited

U.S. PATENT DOCUMENTS

| | | | |
|---|---|---|---|
| 4,193,370 | 3/1980 | Schoell | 114/291 |
| 4,233,920 | 11/1980 | Wood et al. | 114/56 |
| 4,361,102 | 11/1982 | Wood et al. | 114/56 |
| 4,813,365 | 3/1989 | Lindstrom et al. | 114/56 |
| 5,279,249 * | 1/1994 | Pepper | 114/356 |
| 5,375,551 | 12/1994 | Lunter et al. | 114/346 |
| 5,685,253 * | 11/1997 | Alexander, Jr. | 114/291 |

* cited by examiner

*Primary Examiner*—Stephen Avila
(74) *Attorney, Agent, or Firm*—Richard L. Marsh

(57) ABSTRACT

A hull for a boat comprises a centrally located V-shaped keel a first strake disposed at an outboard edge of a first deadrise adjacent the keel portion, a second strake disposed at an outboard edge of a second deadrise adjacent a first chine rising from the first strake and a third strake disposed at an outboard edge of a third deadrise wherein the third dead rise is joined to the second chine. At least one of the first, second or third chines is a flat chine, at least one of the first, second or third chines is a reverse chine and at least one of the first, second or third chines is a combination chine wherein the combination chine further comprising a pad superimposed upon a reverse chine.

17 Claims, 3 Drawing Sheets

100
130
29
28
26
25
27
72
70
71
35
74
77
76
78
13'
82
80
93
91
92
95
83
85
94
90
22
11
24
13
36
73
55
13''
23
61
60
64
62
15
44
16
43
50
13'''
13

PLANING BOAT HULL AND METHODS OF MAKING SAME

BACKGROUND OF THE INVENTION

1. Field of the Invention

This invention relates to a hull for a boat having a centrally located V-shaped keel portion beginning at the bow of the boat and flaring into a flat pad, the keel having strake and chine pairs disposed on either side of the keel portion. A first strake is disposed at an outboard edge of a deadrise adjacent the keel portion. A first chine joins the first strake to a second dead rise. A second strake is disposed at an outboard edge of the second deadrise. A second chine joins the second strake to a third dead rise and a third strake is disposed at an outboard edge of the third deadrise. At least one of the chines is a flat chine, one is a reverse chine and one is also a combination chine which further comprises a flat pad superimposed upon a reverse chine. As used hereinafter, a strake or a strake pair which is commonly used to denote a line of planing in a wooden ship's side denotes a planar surface running lengthwise along the hull bottom providing lift or acting as the planing surface. The chine is the juncture of the side of the hull with the bottom in a V-shaped hull, however, the term "chine" also refers to any juncture between hull portions where a hull portion makes a sharp turn upward at the edge of the strake toward the side of the boat. Herein, a chine refers to a chine pair disposed on both sides of the centerline of hull. The deadrise is the angle that the bottom of the boat makes with an imaginary horizontal line representing the waterline. The dead rise may be a constant angle but usually varies along a given surface from the stem to the stern. A standard V-shaped hull design has one deadrise sloping away from the keel and one chine at the juncture of the deadrise with the side of the boat hull.

2. Prior Art Statement

Small boats, particularly those pleasure craft twelve feet or less in length, are subject to certain additional regulations not required of larger craft. One, in particular, states that the craft must negotiate a one hundred eighty degree turn at fill throttle without backing off the throttle. Negotiating such a turn may cause a craft to side-slip through the water, porpoise fore and aft and/or chine walk by yawing right to left while also rolling from side to side. Any of these reactions may also result in discharge of one or more occupants in the craft. Thus, the design of the hull of a boat is critical in alleviating adverse handling characteristics and achieving ride comfort while complying with all boating regulations including the high speed turn. Though the high speed turn requirement does not exist in craft longer than twelve feet L.O.A, (overall length), turning control of these larger craft has been attempted.

For instance, it is known to provide a design for a larger craft boat hull having chine portions joining an upper hull portion to a lower hull portion wherein the chine portions have a substantially horizontal portion extending outwardly from the edges of the lower hull and a chine lip portion extending downwardly at a reverse direction from 12 to 18 degrees from the horizontal. For instance, see the U.S. Pat. No. 4,193,370 issued on Mar. 18, 1980 to Harry L. Schoell.

Additionally, it is known to provide a V-shaped hull design with improved turning characteristics for a larger boat wherein the hull has a plurality of chine pairs comprising downwardly directed wedges extending fore and aft on opposite sides of a centerline keel portion wherein the keel portion comprises a forward V-section merging with a concave planing pad via an upwardly and rearwardly directed transition area. For instance, see the U.S. Pat. No. 4,233,920 issued on Nov. 18, 1980, to Wood, et al.

It is also known to provide a hull design with improved turning characteristics for deep V-hull larger craft wherein the hull design has a planar central running surface extending fore and aft and a concave outboard running surface extending fore and aft wherein the central running surface is separated from the outboard running surface by downwardly directed wedge shaped chines. For instance, see the U.S. Pat. No. 4,361,102, issued Nov. 30, 1982 on to Wood, et al.

It is known to provide a hull design with improved turning characteristics for a deep V-shaped boat hull wherein the hull has two reflex or reverse chine pairs separated by a second deadrise having an angle greater than a first deadrise between the keel and the first reflex chine pair. For instance, see U.S. Pat. No. 4,813,365 issued Mar. 21, 1989 to Lindstrom, et al.

Finally, it is known to provide a water jet saucer having a low beam to length ratio wherein the jet saucer has a substantially rounded bottom and is devoid of lift strakes, deadrises or chine pairs. For instance, see the U.S. Pat. No. 5,375,551 issued on Dec. 27, 1994 to Lunter, et al.

SUMMARY OF THE INVENTION

As hereinbefore recited, the design of the hull of a boat operated in high speed turns can exhibit significant side-slip where the boat urns but slides along in its generally original path as well, or it can exhibit or aggressive biting into the water surface as the severity of the turn increases depending on how the hull is configured. Significant side-slip typically occurs with boats having either substantially flat bottoms or V-hulls with no means, such as chines, to prevent the side-slip. The prior art has addressed the side slippage of these boats by providing downwardly directed wedge shaped chine pairs on either side of the central keel portion as described in the aforementioned V-shaped hull patents. Boats constructed according to these patents however, are very aggressive in turns producing significant biting into the water and the attendant centripetal side forces causing the operator to experience high g-forces in a tight turn at full-out speed, that is at full throttle. The saucer type boat of U.S. Pat. No. 5,375,551 has the opposite handling in turns wherein the saucer side-slips wildly as it has no chines to dig into the surface of the water. High g-forces are still created though by the high output jet pump driving the boat as these high g-forces occur at the moment when the nozzle direction on the pump is abruptly changed causing the saucer to spin about its vertical axis while continuing to move generally along the original course. Pleasure boaters are not accustomed to, or always prepared for these high g-forces and some boaters have been discharged from a pleasure boat in certain high speed turns. Furthermore, pleasure boaters often want to experience a smooth, stable, predictable ride in straight line boating as well as on turns without high g-forces. Additionally, when towing a skier, the pleasure derived from the high speed skiing is lost. Therefore, when using a boat according to the prior art patents, pleasure boaters are forced to significantly reduce speed in turns to prevent the discomfort of the aggressive maneuvering characteristics or the wild sliding of the saucer craft.

The boats of the prior art V-shaped hull patents are primarily intended for high speed fishing boats driven by an outboard engine mounted on a transom of the boat or by an inboard/outboard gear housing mounted at the base of the transom, where the transom is substantially at the rearmost extension of the boat. These boats may have either a propeller or a jet discharge for propulsion but the prop or discharge is disposed well below the waterline at the bottom of the driving unit. V-shaped hull boats driven by inboard mounted jet pumps have different handling characteristics as the steerage of the boat is directed by moving a nozzle of the discharge port from side to side without the rudder like extension of an outboard or inboard/outboard propeller housing. In an inboard mounted jet pump, the nozzle may be substantially at the rearmost portion of the boat but typically is spaced inboard therefrom along the centerline in a discharge tunnel at the keel line of the boat. Thus, the nozzle exits above the waterline creating the propulsion force substantially at and along the keel centerline at a distance spaced inwardly from the transom not outboard and below thereof as in the boats described in the V-shaped hull patents. In a turn, the turning moment about the central axis of the boat propelled by a jet pump is quite different from the tun moment about the central axis of a boat propelled by an outboard propeller, for instance, an inboard driven jet pump creates an opposing force against the hull to steer the boat whereas an outboard propeller pulls the engine in the new direction to steer the boat. Thus, it has been found that the bottom surface of a prior art boat which has a plurality of downwardly directed, wedge shaped chines separated by deadrises is not suitable for a bottom surface of a jet pump propelled boat particularly in maneuvering a jet pump propelled boat through high speed turns.

Therefore, it is an object of this invention to provide a hull design for a boat, the hull design comprising a centrally located V-shaped keel portion, a first strake and a first chine disposed at an outboard edge of a first deadrise adjacent the keel portion, a second strake and a second chine disposed at an outboard edge of a second deadrise adjacent the first chine, a third chine disposed at an outboard edge of a third deadrise joined the second chine where at least one of the first, second or third chines is a flat chine, at least one of the first, second or third chines is a reverse chine and at least one of the first, second or third chine is a combination chine further comprising a flat pad superimposed upon a reverse chine.

It is another object of this invention to provide a hull design for a boat, the huff design comprising a centrally located V-shaped keel portion, a first chine, a second chine and a third chine where at least one of the first, second or third chines is a combination chine further coming a flat pad superimposed upon a reverse chine and wherein the pad superimposed upon the reverse chine has a portion of the length of the pad disposed at an angle to the pad establishing a flared portion of the combination chine.

It is yet another object of this invention to provide a hull design for a boat, the hull design comprising a centrally located V-shaped keel portion having a plurality of chines outboard the keel portion where at least one of the chines is a combination chine comprising a pad superimposed upon a reverse chine and wherein the pad superimposed upon the reverse chine has a portion of the length of the pad disposed at an angle to the pad establishing a flared portion of the combination chine with the pad width at a terminal end of the flared portion greater than the width at an apex of the angle of the flared portion.

It is still another object of this invention to provide a hull design for a boat, the hull design comprising a centrally located V-shaped keel portion having a combination chine disposed outboard of the keel portion comprising a pad superimposed upon a reverse chine and wherein the pad suppose upon the reverse chine has a portion of the length of the pad disposed at an angle to the pad establishing a flared portion of said combination chine with the terminal end of the flared portion contiguous with a stern portion of the hull. The portion of the pad is thus disposed at an angle to the remainder of the pad enabling the boat hull to be tuned to the type of cornering characteristics that the builder desires. For instance, the boat hull may be tuned to corner quite aggressively until the speed is such or the degree of cornering or combination of these effects causes water to break from under the reverse chine and the stern of the boat drifts across the water in a slide.

It is also an object of this invention to provide a structural combination strake for a boat hull comprising a strake superimposed upon a reverse chine wherein the strake extends along the reverse chine at least a portion of the length of the reverse chine.

It is a further object of this invention to provide a structural chine having a strake superimposed upon a reverse chine which also has a portion of the length of the strake disposed at an angle from one to more than ten degrees to the strake establishing a flared portion of the combination structural chine.

Yet another object of this invention is to provide a structural chine having a flared portion of a pad superimposed upon a reverse chine, the pad having a width at a terminal end of the flared portion greater than a width at an apex of the angle of the flared portion and wherein the terminal end of the flared portion is contiguous with a stern portion of the chine. This removes a portion of the hull from the water when the boat is on plane thereby reducing drag and increasing speed.

A further object of this invention is to provide a structural chine having a flared portion of a pad superimposed upon a reverse chine wherein the terminal end of the flared portion is blended into an adjacent deadrise at the terminal end of the pad.

Finally it is an object of this invention to provide a method of constructing a hull for a pleasure boat, the hull design comprising a centrally located V-shaped keel portion, a first strake and a first chine disposed at an outboard edge of a first deadrise adjacent the keel portion, a second strake and a second chine disposed at an outboard edge of a second deadrise adjacent the first chine, a third chine disposed at an outboard edge of a third deadrise joined the second chine where at least one of the first, second or third chines is a flat chine, at least one of the first, second or third chines is a reverse chine and at least one of the first, second or third chine is a combination chine comprising a flat pad superimposed upon a reverse chine, the combination chine imparting improved turning characteristics to the boat.

DESCRIPTION OF THE PREFERRED EMBODIMENTS

While the various features of this invention are hereinafter described and illustrated as a design for the hull of a boat, the boat hull comprising a centrally located V-shaped keel portion, a first strake and a first chine disposed at an outboard edge of a first deadrise adjacent the keel portion, a second stake and a second chine disposed at an outboard edge of a second deadrise adjacent the first chine, a third chine disposed at an outboard edge of a third deadrise joined to the second chine where at least one of the first, second or third chines is a flat chine, at least one of the first, second or third chines is a reverse chine and at least one of the first, second or third chine is also a combination chine further comprising a flat pad superimposed upon a reverse chine, it is to be understood that the various features of this invention can be used singly or in various combinations thereof to alter the handling characteristics of a boat having the improved hull design and, in particular, the side slippage of a boat hull in a tight turn under full throttle may be tuned to corner quite aggressively until the speed is such or the degree of cornering or combination of these effects causes water to break from under the reverse chine and the stern of the boat drifts across the water in a slide as can hereinafter be appreciated from a reading of the following description.

Figure 1:
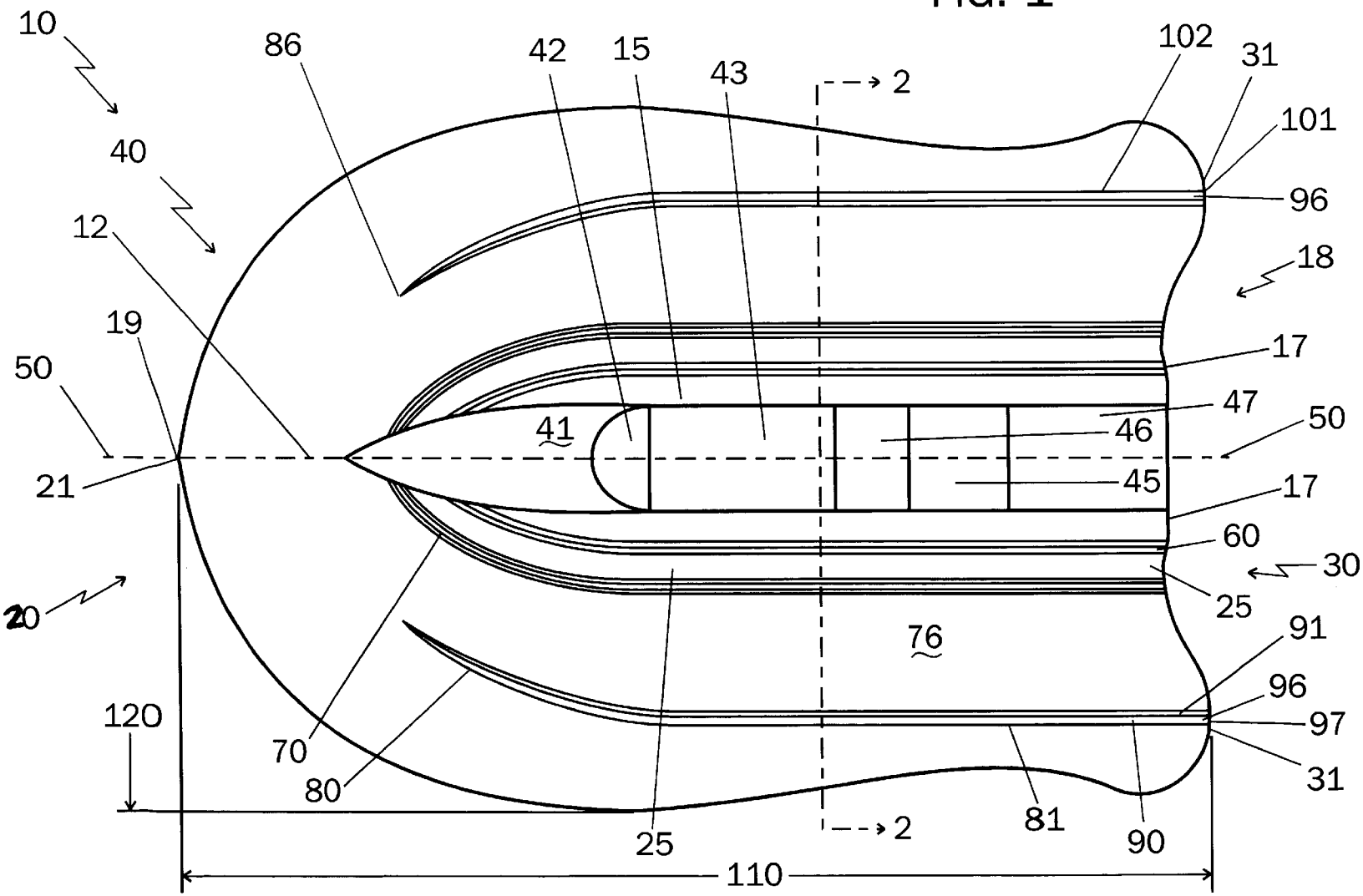
FIG. 1 is a plan view of the bottom of the hull of one embodiment of the boat of this invention.

Referring to FIG. 1, a design of a hull 10 of this invention for a boat has a length 110 and a beam 120, length 110 measured along a longitudinal axis 50 of hull 10 from a forward most point 21 on a bow portion 20 thereof to a rearward most point 31 on a stern portion 30 thereof Beam 120 is measured transverse longitudinal axis 50 on a horizontal plane 13 across hull 10 where hull 10 is greatest in width. Length 110 is greater than beam 120 and may be from 1.2 to 3 times greater. The hull 10 of this invention has a length to beam ratio more particularly from about 1.2 to 1.4 and is powered by a engine driven pump jet. Hull 10 has a stem 12 located on centerline or longitudinal axis 50, stem 12 comprising the central structural member in the forward most or bow portion 20 and curves downwardly from forward most point 21 extending into a keel 40. Keel 40 extends rearwardly along centerline 50 toward stern portion 30 and may terminate in an upwardly directed transom spanning across stern portion 30 between rearward most points 31, however, keel 40 of this invention has a reflex curvature 18 to stern portion 30 and keel 40 terminates inwardly toward bow portion 20 from rearward most points 31. Keel 40 is characterized by a V-shaped portion 41 at the base of stem 12, a tapered portion 42 immediately aft of V-shaped portion 41, a flat portion 43 aft of tapered portion 42, a gullet 46 aft of flat portion 43 and a pump mount clamber 45 aft of gullet 46. Pump mount 45 may extend to a point 17 both sides of stern portion 30, points 17 spaced inwardly from rearward most points 31 but pump mount 45 generally is followed by an enlarged open bottom discharge chamber 47, chamber 47 terminating at points 17. Tapered portion 42 is provided to produce substantially laminar flow of water along flat portion 43 such that gullet 46 may receive a full throat of water for the inlet to the pump. A jet pump, not shown, is generally mounted on pump mount 45 substantially along the keel centerline 50 below the center of buoyancy and thus provides an upward lift component to hull 10 as well as the significant forward thrust component for propelling the boat through the water.

Figure 2:
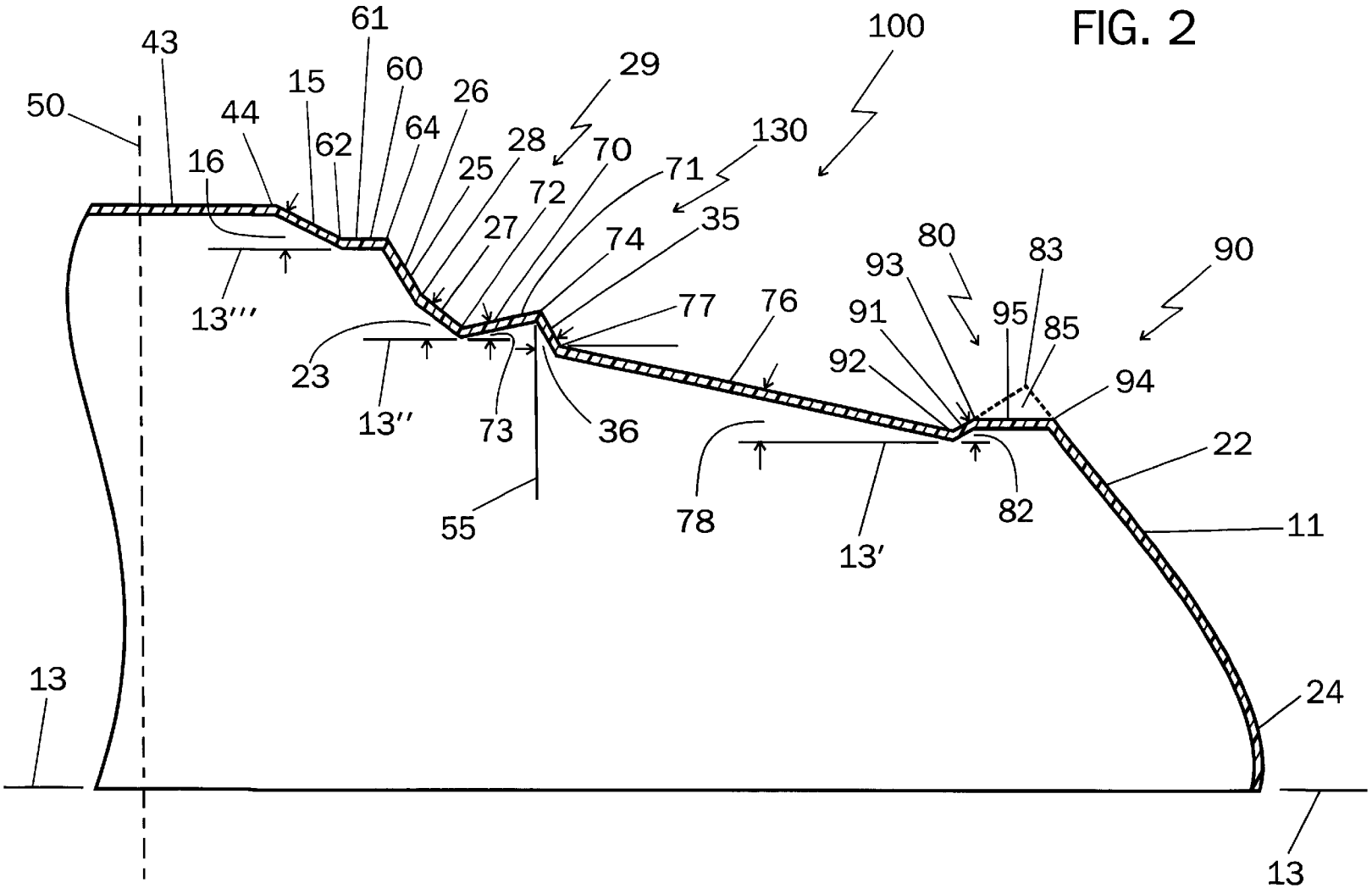
FIG. 2 is an section view along lines 2—2 of the hull of one embodiment of the boat of this invention showing a combination chine adjacent the outboard deadrise.

Referring now to FIGS. 1 and 2, the bottom surface 100 of a hull 10 for a boat comprises bow portion 20, stern portion 30, and keel portion 40, keel portion 40 extending longitudinally from bow portion 20 to stern portion 30 located on centerline 50. A first strake 60 is disposed at an outboard edge or valley 62 of a first deadrise 15 adjacent keel portion 40, a second strake 70 is disposed at an outboard edge or joint 72 of a second deadrise 27 adjacent a first chine 25, first chine 25 joined to first strake 60 at the outboard edge or corner 64 of first strake 60 and first chine 25 joined to second deadrise 27 at common line 28. A third chine 80 is disposed at the outboard edge or juncture 92 of a third deadrise 76, third deadrise 76 joined to second chine 35 at joint 77 adjacent to second strake 70. Second chine 35 is contiguous with and joined to second strake 70 at a chine peak 74. At least one of first, second or third chines 25, 35, 80 is a flat chine and at least one of first, second or third chines 25, 35, 80 is a reverse chine. At least one of first, second or third chines 25, 35, 80 is additionally a combination chine comprising a reverse chine joined to a flat chine or may comprise a pad 95 superimposed upon a reverse chine as will be hereinafter filly described and disclosed.

As with prior art hulls, flat surfaces substantially parallel with a horizontal plane 13 such as strakes 60 and 70 are employed to direct the flow of water along the bottom surface 100 of the V-shaped hull 10 and to provide lift to the boat. These strakes are arranged in pairs, one strake of a strake pair spaced a distance from the centerline of the boat on one side of the centerline of the keel, the other strake of that strake pair spaced the same distance from the centerline of the boat on the opposite side of the keel. For instance, strake 60 has valley 62 spaced a given distance from centerline 50 on both sides of keel 40 with strake 60 extending outwardly therefrom. Strake 60 is a planar surface disposed at valley 62 outboard of first deadrise 15, strake 60 functioning as the planing surface 61 for hull 10 when a boat with hull 10 is at full out speed. Strake 60 is followed by an steep angled surface 26 rising to an adjacent deadrise 27 or another strake 70. Strake 60 is generally parallel to the horizontal plane 13 of the boat and may be parallel to other strakes or to the flat bottom of boat hull 10. The purpose of a stake is to provide a planing surface separating deadrises to keep the boat on an even keel when riding on the strake. Strake 60 also allows water to escape along its outer edge or corner 64 while hull 10 rides upon planing surface 61.

Steep angled surface 26 is generally called a chine, that is, a juncture between hull portions where the hull portion makes a sa turn upward at the edge of the strake toward the side of the boat. The purpose of the steep angled surface 26 adjacent the step strake 60 is to bite into or grab the surface of the water during a turn to keep the boat from side slipping through the turn When in straight line full out boating on open water, a boat without a chine at or near the edge of the portion of the bottom surface on plane will continuously wallow or roll from one side causing an uncomfortable ride. Rolling side to side, yawing right to left, porpoising bow up and down or a combination of these effects through a turn has been also described as "chine walk." Generally, chine walk is a rolling of the boat back and forth between two adjacent chines as one digs into the water causing the boat to roll opposite or into the turn releasing the vertical surface of the outboard chine & slapping the water with the surface of the next inboard chine while yawing and porpoising becoming secondary effects The boat then slides sideways into the turn and the outboard chine again bites into the water repeating the chine walk. Most of this chine walk takes place near the stern of the boat as the stern alternately bites into the water and side-slips through it. Thus, the less experienced boater will experience great discomfort with high speed turns and will significantly close the throttle to alleviate the adverse effects of chine walk. Current hull designs on the market have achieved control of one of these characteristics to some degree of success especially in high speed bass fishing boats as described by Wood, et al., however pleasure craft require less aggressive handling characteristics and smoother ride. Thus, another strake, such as strake 70, is generally disposed outboard of the first chine 25 to provide a substantially flat surface spaced from keel 40 to assist in providing a resisting moment to the natural rolling of the boat. A short deadrise, such as deadrise 27, may be disposed between first chine 25 and second strake 70 to provide for the proper resisting moment distance from the keel 40. Second strake 70 may be parallel to horizontal plane 13, however, it has been found by the teachings of this invention that yawing, rolling and especially porpoising can be significantly reduced by angling second strake 70 toward bow portion 20. Thus, upon acceleration from a stop or slow speed, angling of second strake 70 forwardly forces the bow of the boat downwardly by providing a lifting moment to the stern of the boat. In high speed turns, second strake 70 becomes a controlling planing surface keeping hull 10 up on plane while second chine 35 is the controlling turning surface keeping hull 10 tracking straight in the water. As second stake 70 provides lift to the stern and second chine 35 provides resistance to side slipping, a hull 10 of the design of this invention turns smoothly through the water as the boat hull 10 is tuned to corner quite aggressively until the speed is such or the degree of cornering or combination of these effects causes water to break from under the reverse chine 80 and the stern of the boat drifts across the water in a slide.

Second strake 70 may alternately comprise a combination chine 130 as shown in FIG. 2 wherein a reverse or reflex chine 71 joins second chine 35 at chine peak 74. Combination chine 130 provides a more defined planing surface as well as providing substantial structural support to hull 10 at chine pea 74. Reverse chine 71 is characterized by a surface rising inwardly toward keel 40 from chine peak 74 at an angle 73 to the horizontal plane 13 of the boat hull 10 and terminates at the next inboard surface such as deadrise 27. Angle 73 is shown between the horizontal line 13" parallel to horizontal plane 13 and reverse chine 71. It has been found by the teachings of this invention that reverse chine 71, when used, must be angled toward the bow portion 20 as second strake 70 is angled to provide the necessary lifting moment to boat hull 10 so the inwardly angled surface will tend to retain water directing the water inwardly along reverse chine 71 toward the stern portion 30 of the boat hull 10.

Still referring to FIG. 2, hull 10 further comprises a third deadrise 76 rising outwardly and upwardly from joint 77 to a reverse chine 80 adjacent the outer edge of bottom surface 100 at the hull side 11. In this embodiment of the hull design of this invention, strake 60 is a flat strake parallel to flat portion 43 of keel portion 40, strake 70 is substantially flat but angled toward the bow 20 to provide lift to hull 10 and reverse chine 80 is truncated to provide for a pad 95 running substantially along the entire length of reverse chine 80 while a flared portion 96 of pad 95 is further angled toward stern portion 30 from an apex 81 spaced inwardly from rearward most point 31 on stem 30. Thus, flared portion 96 of pad 95 keeps water from trapping along reverse chine 80 as the reverse portion 91 of reverse chine 80 is essentially removed at stern 30 and therefore, water escapes under portion 96 allowing stern 30 of hull 10 to slide slightly in a high speed turn.

As is best observed in FIG. 2, a cross section of half the hull 10 of this invention is shown inverted. The cross section is taken approximately amidships through flat portion 43 just prior to the gullet 46, gullet 46 providing an inlet channel for the inlet of the jet pump (not shown) driving the boat. The lowermost portion of hull 10 comprises generally flat portion 43 preceding a deadrise 15, deadrise 15 joined to flat portion 43 of keel 40 at merge 44. Merge 44 is typically a small radius such that stress is not created between deadrise 15 and keel portion 40, in fact the junctures between the various surfaces descried hereinafter are similarly radiused for the same purpose. Though the cross section shown in FIG. 2 is at a specific point in hull 10, the surfaces described here and hereinafter generally extend from a stern portion 30 to a bow portion 20 of hull 10 as can be observed in FIG. 1.

Proceeding outboard from flat portion 43, strake 60 is disposed immediately adjacent deadrise 15 and joined hereto at valley 62, strake 60 providing planing surface 61 of hull 10 spaced outwardly from the keel 40 toward the side 11 of hull 10. Strake 60 extends from stern 30 to bow portion 20 and is melded into V-shaped portion 41 of keel 40 at stem 12. Planing surface 61 of strake 60 is defined between valley 62 and corner 64 and is substantially parallel to flat bottom portion 43 of keel 40. Strake 60 terminates in corner 64 where it is joined to the next outboard surface, first chine 25. A compound surface 29 may comprise first chine 25 and second deadrise 27, compound surface 29 joined at a common line 28 or surface 29 may be a single surface extending from corner 64 to joint 72 adjacent second strake 70. In this embodiment, compound surface 29 comprises first chine 25 adjacent deadrise 27 wherein the angle defining deadrise 27 is disposed at a surface angle 23 to the horizontal line 13". Angle 23 is essentially parallel to deadrise 15 or deadrise 76 though these deadrise angles may be different from one another. In the hull 10 of this invention, compound surface 29 comprises two separate surfaces, first chine 25 extending from corner 64 to common line 28 and second deadrise 27 extending from common line 28 to joint 72, second deadrise 27 being disposed substantially parallel to deadrise 15. Likewise, first chine 25 is disposed at an angle substantially the same as second chine 35 as hereunder defined. Strake 60 joined to first chine 25 thus functions as a longitude spar strengthening hull 10 in the longitudinal direction to better resist impact upon the surface of the water created as hull 10 moves through the water.

Where reverse chine 71 is used in place of strake 70, reverse chine 71 is angled upwardly toward centerline 50 of huff 10 and angled toward bow portion 20. Reverse chine angle 73 between horizontal line 13" of hull 10 and reverse chine 71 is not more than twenty degrees and, when used, is usually between two and ten degrees. In hull 10 of this invention, there is no reverse chine angle 73, however strake 70 is angled toward the bow at an angle generally less than about ten degrees and usually about two degrees. Strake 70 extends from stem portion 30 to bow portion 20 and also melds into V-shaped portion 41 at stem 12. Strake 70 terminates in chine peak 74 joining second chine 35 thereat. Second chine 35 is disposed at an angle 36 to the vertical plane 55, vertical plane 55 being perpendicular to horizontal plane 13. Angle 36 is from about 50 to about 90 degrees and is usually about 60 degrees. The steeper the angle of angle 36, the greater the bite of the hull 10 into the water in a turn. As with stroke 60, strake 70 with second chine 35 appended thereto also functions as a longitudinal spar thereby strengthening hull 10.

Third deadrise 76 is disposed outwardly of second chine 35 and is joined to second chine 35 at joint 77. Deadrise 76 is disposed at an angle 78 to horizontal line 13' of between five and thirty degrees and is usually between ten and twenty degrees. Angle 78 for deadrise 76 of this invention is 11 degrees at the point along hull 10 where section 2—2 is taken, however, deadrise 76 varies throughout the length of hull 10 generally increasing as deadrise 76 approaches bow portion 20. As can be observed in FIG. 2, deadrise 76 comprises a substantial portion of the wetted portion of bottom surface 100 when hull 10 of the boat is at rest, however, when underway, and especially at fill out throttle, only a portion of keel portion 40, first deadrise 15 and first strake 60 at the aft end of hull 10 is wetted.

It has been found according to the teachings of this invention that turning characteristics of a boat built with a hull 10 of this invention are greatly improved by truncating reverse chine 80 removing the truncated portion 85 as shown in phantom tines. Reverse chine 80 thus becomes a combination chine 90 having a reverse portion 91 and a pad portion 95 superimposed thereupon. Reverse portion 91 is joined to third deadrise 76 at juncture 92 and extends outwardly at a reverse chine angle 82 from two and twenty degrees, usually between two and ten degrees and, in this embodiment, is about four degrees. Reverse chine angle 82 is disposed relative to horizontal line 13' defining reverse portion 91 which, before truncation, proceeds from juncture 92 to summit 83. As reverse chine 80 has been truncated to provide for the combination chine 90 of this invention, reverse portion 91 terminates at transition 93 and pad 95 is then disposed between transition 93 and edge 94, edge 94 constituting the radiused joint between the bottom surface 100 and side 11 of hull 10. Pad 95 extends substantially along the entire length of reverse chine 80 from a point 86 on bow portion 20 to apex 81 of a flare 96 adjacent stern portion 30, flare 96 to be fully described hereinafter. Pad 95 is substantially flat and also substantially parallel to strake 60 and flat portion 43 of keel 40. By truncating reverse chine 80 at outboard edge of bottom surface 100, hull 10 is relieved of the aggressive bite into the water by summit 83 allowing hull 10 to side-slip slightly through a turn without chine walking as the water channeled along reverse portion 91 provides sufficient support to the outer edge of bottom surface 100. Pad 95 may be of any length, however, pad 95 extends the entire length of reverse chine 80 from point 86 to rearward most point 31 on stern 30. Though pad 95 generally provides a less aggressive bite into the water, it has been found by the teachings of this invention that flare 96 provides additional assistance in negotiating turns at full out speed. The dashed lines shown in FIG. 3 extending from apex 81 of flare 96 show the fill extension of pad 95 before flare 96 is applied to pad 95.

It is apparent from the foregoing description that the hull 10 of this invention comprises a centrally located V-shaped keel portion 40, first strake 60 and a first chine 25 disposed at an valley 62 of a first deadrise 15 adjacent keel portion 40, a second strake 70 a second chine 35 disposed at joint 72 of a second deadrise 27 adjacent first strake 60 and first chine 25 and a third chine 80 disposed at an juncture 92 of a third deadrise 76 joined to a second chine 35 adjacent second strake 70. It is also readily apparent that at least one of first, second or third chines 25, 35, 80 is a flat chine and that first strake 60 is disposed adjacent V-shaped keel portion 40. Furthermore, at least one of first, second or third chines 25, 35, 80 is a reverse chine and that second strake 70 is disposed outboard of a second deadrise 27 adjacent strake 60 and reverse chine 80 is disposed outboard of an third deadrise 76 adjacent second strake 70. Finally, at least one of first, second or third chines 25, 35, 80 is a combination chine 90 or 130, combination chine 130 comprising a reverse chine such as reverse chine 71 joined to a flat chine or such as second chine 35 and combination chine 90 comprising a pad 95 superimposed upon reverse chine 80 by truncating a portion 85 of reverse chine 80.

Figure 3:
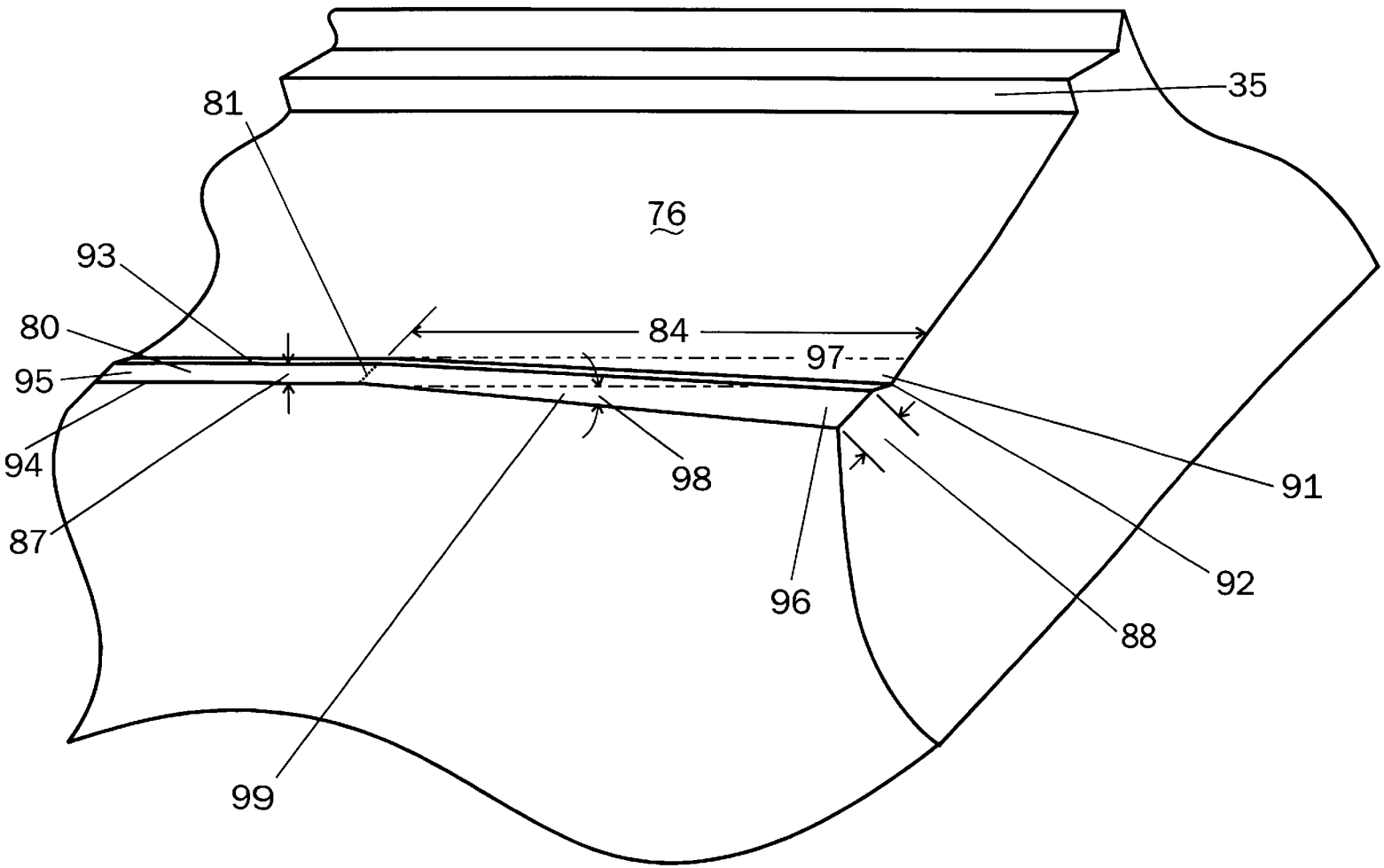
FIG. 3 is an greatly enlarged partial perspective view of the stern portion of the combination chine of FIG. 2 showing a flared portion of the combination chine.

Referring now to FIGS. I and 3, hull 10 with combination chine 90 has at least one pad 95 superimposed upon reverse chine 80 and further has a portion 99 of the length of pad 95 disposed at a trailing angle 98 to pad 95 establishing a flared portion 96 on combination chine 90. FIG. 3 shows a broken away portion of hull 10 of FIG. 1 enlarged to show the details of flared portion 96. Flare 96 begins inboard from stern portion 30 at apex 81 of angle 98. As the discharge from the pump is directed to one side or the other to initiate a turn, flare 96 effectively eliminates any resisting moment created by reverse chine 80 allowing flare 96 to side-slip stern portion 30 of hull 10 through the turn. The resulting turn is smoother without chine walk or porpoising as flare 96 has eliminated the additional portion 85 of summit 83 from stern portion 30 from biting into the surface of the water. Furthermore, as flare 96 contacts the water in a turn, the greater surface area of flare 96 provides a slight planing force essentially at the outboard, rearmost point 101 of bottom surface 100 thereby returning hull 10 to full planing contact with the water. Flare 96 widens from apex 81 toward rearward most point 31 thus establishing a width 88 at a terminal end 97 of flared portion 96 greater than a width 87 at apex 81 of angle 98 of flared portion 96. As flared portion 96 extends to rearward most point 31 of stern portion 30, terminal end 97 of flared portion 96 is contiguous with stern portion 30 of hull 10. The terminal end 97 of flared portion 96 may be blended into adjacent deadrise 76 at terminal end 97 such that reverse portion 91, juncture 92 and transition 93 become a part of adjacent deadrise 76 and thus flared portion 96 and adjacent deadrise 76 appear to be one surface at terminal end 97. Angle 98 may be up to twenty degrees, but in this embodiment, is from about two to about five degrees. Those skilled in the art will realized that reverse portion 91 and pad 95 provide sufficient support to the outermost edge of hull 10 while traveling on plane in a straight line while flared portion 96 provides for a righting moment in a turn preventing the aforementioned handling anomalies consistent with boat hulls of current construction.

As a structural element, combination chine 90 having pad 95 disposed thereon is a channel shaped structure sit in to a channel beam used in building construction. The channel shaped structure of combination chine 90 has further been found to provide additional strength to hull 10 at outboard edge 94 of bottom surface 100 and that combination chine 90 also provides additional side impact strength to outboard edge 94 of side 11 of hull 10. As can be readily observed in FIG. 1, reverse chine 80 gradually disappears at bow portion 20 as deadrise 76 gradually increases in angle with respect to horizontal plane 13 until deadrise 76 becomes coincident with hull side 11 in bow portion 20. Similarly, pad 95 becomes a part of deadrise 76 and hull side 11 in bow portion 20 where pad 95 is disposed upon reverse chine 80.

Though the above descriptions have been particularly applied to reverse chine 80 at outboard edge 94 of bottom surface 100, a structural combination chine 90 for a boat hull 10 may be constructed at another location on bottom surface 100 wherein structural combination chine 90 comprises a pad 95 superimposed upon a reverse chine 80 and wherein pad 95 extends along reverse chine 80 at least a portion of the length thereof. For instance, structural combination chine 90 may be constructed on reverse chine 71, where used, with like components being disposed thereon and thus pad 95 superimposed upon reverse chine 71 may also have a portion 84 of the length of pad 95 disposed at an angle 98 of up to twenty degrees to pad 95 establishing a flared portion 96 of combination chine 90. As with combination chine 90 on reverse chine 80, a combination chine 90 on reverse chine 71 may have flared portion 96 with a width 88 at terminal end 97 of flared portion 96 greater than width 87 at an apex 81 of angle 98 of flared portion 96. Terminal end 97 of flared portion 96 on such a combination chine 90 on reverse chine 71 may also be contiguous with a stern portion 30 and may also be blended into adjacent deadrise 27 at terminal end 97. Such a combination chine 90 constructed upon another reverse chine may have its pad surface 95 disposed substantially parallel to another strake, such as strake 60, or to a flat portion 43 of a keel portion 40 or to another pad surface 95 of another combination chine 90. One combination chine having pad 95 formed upon a reverse chine is usually sufficient to effectively control a small craft in a high speed turn however, the use of another combination chine 90 on another reverse chine may be advantageous for a hull 10 of another era. Similarly, flared portion 96 usually is formed upon one pad 95 of one combination chine 90 however, flared portion 96 may also be formed upon any number of combination chines 90 utilized in a hull 10 of a boat.

In a modeling method of constructing a hull 10 for a boat, wherein hull 10 has a length 110 and abeam 120, stem 12 is formed from a length of material in an upward curve from a V-shaped keel portion 40, stem 12 extending to forward most point 21 on bow portion 20. Planar keel portion 43 having a flat bottom is formed aft of tapered portion 42, tapered portion 42 formed immediately aft of and contiguous with V-shaped keel portion 40. Flat portion 43 is stepped upwardly having a gullet 46 formed aft thereof, gullet 46 extending rearwardly to a pump mount chamber 45. Keel 40 terminates in an open bottom, open end discharge chamber 47 formed aft of pump mount chamber 45. Hull 10 has length 110 measured along a longitudinal axis 50 of hull 10 from a forward most point 21 on a bow portion 20 of hull 10 to a rearward most point 31 on a stern portion 30 of hull 10 while beam 120 is measured transverse longitudinal axis 50 on a horizontal plane 13 across hull 10 wherein huff 10 is greatest in width. In this embodiment, length 110 is greater than beam 120 and more particulars, length 110 is from about eight feet to about ten feet while beam 120 is from about seven feet to about nine feet. A bottom surface 100 is formed outwardly in both directions curving gently upwardly from keel portion 40 to beam width 120 and curving gently forwardly to stem 12, bottom surface 100 having a plurality of chines 25, 35 and 80, strakes 60 and 70 and deadrise portions 15, 27 and 76. Strake 60 is formed outboard of flat portion 43, chines 25 and 35 formed on opposite edges of and thus separated by deadrise 27 and strake 70 while chines 35 and 80 are formed on opposite edges of and hence separated by deadrise 76. Side 11 of bull 10 is formed upwardly from an outer edge 102 of bottom surface 100 to horizontal plane 13 surrounding hull 10 extending from rearward most point 31 on each side of stem portion 30 to forward most point 21 at the terminus 19 of stem 12. Stern portion 30 is formed across from rearward most point 31 on one side of hull 10 to rearward most point 31 on an opposite side thereof extending upwardly from bottom surface 100 and from discharge chamber 47 to horizontal plane 13.

Structural chine pairs 25, 35 and 80 are formed into bottom surface 100 spaced from keel portion 40. Referring to FIG. 2 wherein one half of hull 10 is shown in cross section, first strake 60 is formed at an outboard edge or valley 62 of a first deadrise 15 adjacent keel portion 40, a second strake 70 is formed at an outboard edge or joint 72 of a second deadrise 27 adjacent first strake 60 and a third chine 80 is formed at juncture 92 of a third deadrise 76 joined to a second chine 35 adjacent second strake 70. Chine pairs 25, 35 and 80 formed onto bottom surface 100 extend from stern portion 30 to bow portion 20, each chine pair terminating at stem 12.

Deadrise 15 is formed outboard of flat portion 43 by forming an angle 16 upwardly on bottom surface 100 from merge 44 on flat portion 43 of keel 40. Deadrise angle 16 is from about one to about thirty degrees from horizontal line 13''' wherein horizontal line 13''' is parallel to horizontal plane 13. Deadrise angle 16 is approximately 25 degrees at the point on hull 10 where cross section 2—2 is taken. Deadrise 15 terminates at valley 62 of strake 60 and extends from stem 30 to bow 20 gradually increasing in angle as deadrise 15 approaches bow portion 20 and gradually decreasing in angle as deadrise 15 approaches rearward most points 17. Strake 60 is formed on bottom surface 100 substantially parallel to horizontal plane 13 and terminates at corner 64. Strake 60 is an inboard most planing surface 61 extending from stern portion 30 to bow portion 20 terminating at stem 12. Formed outboard of strake 60 is compound surface 29 wherein surface 29 may comprise two separate surfaces, deadrise 27 and first chine 25, these surfaces joined at common line 28. Though two surfaces 25, 27 may be used, compound surface 29 is typically only one surface and is formed upwardly from corner 64 at angle 23 of from about one to about sixty degrees and usually about twenty degrees. Where a compound surface 29 is comprised of two surfaces 25 and 27, the angle formed by surface 26 with horizontal line 13" would be greater than the other angle formed by first chine 25 though angle 23 from joint 72 to corner 64 would still be about twenty degrees. Deadrise 27 terminates at joint 72 where second strake 70 begins. Strake 70 is typically angled toward bow portion 20 in order to provide for lift to the stern of hull 10 for better visibility by the operator. Strake 70 may be a reverse chine 71 which is formed on bottom surface 100 by proceeding downwardly from joint 72 at an angle 73, relative to horizontal line 13", of between two and twenty degrees and usually between two and ten degrees. In this embodiment, reverse chine angle 73 is four degrees with reverse chine 71 terminating at chine peak 74. Second chine 35 is formed from chine peak 74 upwardly at an angle 36 relative to vertical plane 55 of from about 50 to about 90 degrees and is usually about 60 degrees. Second chine 35 terminates at joint 77 of third deadrise 76. The angled rib structure formed between second chine 35 and reverse strake 71 constitutes a structural chine adding strength to bottom surface 100 and hence to hull 10.

Third deadrise 76 is formed upwardly at an angle 78 relative to horizontal line 13' from joint 77 at the base of second chine 35 of reverse chine 71 or strake 70 and extends outwardly toward outboard edge 102 of bottom surface 100. At cross section 2—2, angle 78 is 11 degrees but may be between five and thirty degrees. Third deadrise 76 terminates at juncture 92 with outboard chine 80. Outboard chine 80 is typically a reverse chine formed downwardly at an angle 82 from summit 83. Angle 82 is typically from two and twenty degrees, usually between two and ten degrees and, in this embodiment, is about four degrees as measured relative to horizontal line 13'. Reverse portion 91 of reverse chine 80 usually is terminated at summit 83, summit 83 forming the outboard edge 102 of bottom surface 100. The angled rib structure formed between straight portion 22 of side 11 and reverse chine 80 constitutes a structural chine adding strength to bottom surface 100 at outboard edge 102 of hull 10. Side 11 is then formed upwardly from summit 83 to horizontal plane 13, side 11 having a first substantially straight portion joined to summit 83 and ending in a curved gunwale 24 at horizontal plane 13. Each of the surfaces 15, 60, 25, 70, 35, 76, 91, 22 and 24 are joined to an internal framework these surfaces extending from stern portion 30 to bow portion 20. Structural combination chine 90 for a boat hull 10 may be formed in the model by forming pad 95 superimposed upon reverse chine 80 wherein pad 95 is formed along reverse chine 80 at least a portion of the length thereof Pad 95 is formed parallel to strake 60 beginning at transition 93, transition 93 formed by cutting reverse portion 91 at transition 93 and forming thereto flat pad 95. Pad 95 extends to edge 94 of side 11 and is joined thereto. Side 11 is then formed from edge 94 upwardly as described above.

Once the model formed according to the above description is proven, a mold of bottom surface 100 and keel portion 40 is made having a depth from the lowermost point on keel 40 to horizontal plane 13 and hull 10 is made in the mold hereinbefore described by the usual process of laying up a fiberglass substrate in several layers within the mold. Other molds, including injection molds and platen press molds may be used to form hull 10 of other materials suitable for marine use.

While the present invention has been described with reference to the above described preferred embodiments and alternate embodiments, it should be noted that various other embodiments and modifications may be made without departing from the spirit of the invention. Therefore, the embodiments described herein and the drawings appended hereto are merely illustrative of the features of the invention and should not be construed to be the only variants thereof nor limited thereto.

We claim:

1. A hull for a boat comprising a centrally located V-shaped keel portion, a first strake disposed at an outboard edge of a first deadrise adjacent said keel portion, a second strake disposed at an outboard edge of a second deadrise adjacent a first chine joined to said first sake at the outboard corner of said fist strake, a third chine disposed at an outboard edge of a third deadrise joined to a second chine, said second chine joined to said second strake at a chine peak between said second chine and said second strake wherein at least one of said first, second or third chines is a flat chine, at least one of said first, second or third chines is a reverse chine and at least one of said first, second or third chines is a combination chine comprising a pad superimposed upon said reverse chine.

2. A hull as in claim 1 wherein said at least one said pad superimposed upon said reverse chine has a portion of the length of said pad disposed at an angle to said pad establishing a flared portion of said combination chine.

3. A hull as in claim 2 wherein said flared portion has a width at a terminal end of said flared portion greater than a width at an apex of said angle of said flared portion.

4. A hull as in claim 3 wherein said terminal end of said flared portion is contiguous with a stern portion of said hull.

5. A hull as in claim 1 wherein said combination chine provides additional strength to said hull at an outboard edge of a bottom surface of said hull.

6. A hull as in claim 5 wherein said combination chine provides additional side impact strength to said outboard edge at a juncture of said bottom surface to a side of said hull.

7. A hull as in claim 3 wherein said terminal end of said flared portion is blended into an adjacent deadrise at said terminal end.

8. A hull as in claim 2 wherein said angle is from one to ten degrees.

9. A hull as in claim 8 wherein said angle is from two to five degrees.

10. A hull for a boat, said hull having a bow portion, a stern portion and a bottom surface comprising a centrally located keel portion, said bottom surface having at least a first chine, a second chine and a third chine, said chines spaced outboard from said keel, said first chine separated from said keel portion by a first deadrise and a strake, said second chine separated from said first chine by a second deadrise and a strake, said third chine separated from said second chine by a third deadrise, wherein at least one of said chines is a reverse chine, said at least one said reverse chine truncated substantially along the entire length thereof establishing a pad superimposed upon said reverse chine.

11. A hull as in claim 10 wherein said hull has at least one flat chine and said at least one said combination chine.

12. A hull as in claim 11 wherein said pad superimposed upon said reverse chine is parallel to said planing strake.

13. A hull as in claim 10 wherein said at least one said combination chine extends from said stem portion to said bow portion.

14. A hull as in claim 11 wherein said at least one said flat chine extends from said stern portion to said bow portion.

15. A structural combination chine for a boat hull comprising a pad superimposed upon a reverse chine wherein said pad extends along said reverse chine at least a portion of the length of said reverse chine, said pad superimposed upon said reverse chine having a portion of the length of said pad disposed at an angle to said chine thereby establishing a flared portion of said combination chine, said flared portion having a width at a terminal end of said flared portion greater than a width at an apex of said angle of said flared portion.

16. A structural chine as in claim 15 wherein said terminal end of said flared portion is contiguous with a stern portion of said chine.

17. A structural chine as in claim 15 wherein said terminal end of said flared portion is blended into an adjacent deadrise at said terminal end.

* * * * *